US010679526B1

(12) United States Patent
Ritter, Jr.

(10) Patent No.: US 10,679,526 B1
(45) Date of Patent: Jun. 9, 2020

(54) WIND RESISTANT SIGN

(71) Applicant: Michael L. Ritter, Jr., South Bend, IN (US)

(72) Inventor: Michael L. Ritter, Jr., South Bend, IN (US)

( * ) Notice: Subject to any disclaimer, the term of this patent is extended or adjusted under 35 U.S.C. 154(b) by 0 days.

(21) Appl. No.: 16/400,477

(22) Filed: May 1, 2019

(51) Int. Cl.
*G09F 7/22* (2006.01)
*G09F 7/18* (2006.01)

(52) U.S. Cl.
CPC ..... *G09F 7/22* (2013.01); *G09F 2007/1856* (2013.01)

(58) Field of Classification Search
CPC ..... G09F 7/22; G09F 2007/1856
See application file for complete search history.

(56) References Cited

U.S. PATENT DOCUMENTS 1,961,781 A * 6/1934 Reagle ..... E06C 7/083 182/228.3
2,388,180 A * 10/1945 Pulver, Jr. ..... G09F 7/10 40/611.01
D143,902 S * 2/1946 Dwiggins ..... D20/21
3,521,390 A * 7/1970 Carlson ..... G09F 7/002 40/602
4,658,527 A 4/1987 Pingel
5,694,881 A * 12/1997 Creech ..... G09F 15/0056 116/222
6,298,592 B1 * 10/2001 Baier ..... G09F 7/02 40/607.02
6,378,232 B1 * 4/2002 Creech ..... G09F 7/02 248/474
7,089,694 B2 8/2006 Allen
7,150,119 B1 * 12/2006 Nudo, Jr. ..... G09F 7/00 40/615
7,743,539 B1 * 6/2010 Kennedy ..... G09F 7/22 40/607.01
9,275,563 B1 3/2016 Hartman
2003/0019988 A1 1/2003 Barber
2006/0010738 A1 * 1/2006 Roark ..... G09F 11/02 40/479
2009/0013575 A1 * 1/2009 Berteau ..... G09F 7/18 40/617

FOREIGN PATENT DOCUMENTS

FR 2622332 A1 * 4/1989 ..... G09F 15/0087
FR 2647578 5/1989
FR 2647578 A1 * 11/1990 ..... G09F 7/22
FR 2737331 A1 * 1/1997 ..... G09F 15/0087
GB 1428971 A * 3/1976 ..... G09F 11/04

* cited by examiner

*Primary Examiner* — Cassandra Davis
(74) *Attorney, Agent, or Firm* — Botkin & Hall, LLP

(57) ABSTRACT

A wind resistant sign has a frame with vertical supports that are joined and held parallel with respect to each other by a top crossmember and a lower crossmember. The crossmembers and supports form an enclosed area that surrounds a panel. The panel is connected to the frame through pivots that extend into a channel in the panel. The pivots are located closer to the top crossmember and allow the panel to pivot when wind or other forces apply force to the panel. When the force is removed, the panel returns to a vertical orientation. The frame can be driven into the ground to support the frame. The panel is installed on the pivots by bending it to allow the edge to clear the terminal end of the pivot. An optional stiffener can be inserted into one of the channels to increase the rigidity of the sign panel.

17 Claims, 7 Drawing Sheets

68
12
26
66
14
64
46

WIND RESISTANT SIGN

BACKGROUND OF THE INVENTION

This present disclosure relates to yard signs, advertisements, or other displays that are placed on the ground or secured to the ground. It is commonplace for homeowners or businesses to put up signs to show support for a political candidate, advertise a service, support a school activity, root for a team, give directions, advertise a yard sale, promote real estate, or the like. These signs are commonly driven into the soil to hold the sign. Other signs are secured to a base that sits on the ground. The signs are commonly meant for a limited time use, meaning they are not intended to be a permanent installation. For example, a roofing company would promote its services with a sign in the yard of a home getting a new roof, but the sign would not remain in the yard in perpetuity. Political campaign signs have a limited usage and are taken down after an election. Because the signs commonly have a limited time usage, cost, simplicity, and ease of use are important.

Wind and other external forces can take a toll on currently available signs. Current signs commonly use corrugated plastic with graphics printed on them. The stand is thick metal wires or rods that are driven into the ground on one end and corrugated channels of the plastic on the other end. These signs will bend with the wind to some extent, but this creates issues as the plastic can slowly work itself off of the metal wires. The stress from wind can also cause the stand to become loose and/or crooked, resulting in an unsightly display. Further, in climates that get snow, a snow plow clearing the street can obliterate a sign with the force of the snow as it is being discharged by the plow. Other signs can tolerate wind with springs or other moving components, but these are significantly more expensive, more complicated, and sometimes require permanent affixing to a structure. Others have extra parts that can become lost. One example of an attempt to solve the aforementioned problems is covered in U.S. Pat. No. 4,658,527. This patent has a panel that is suspended by two vertical support rods. The sign panel is supported by the rods and can swing, but the support rods are independent, allowing the slip pins to move independently away from or towards each other. This allows the sign panel to become dislodged easily and makes installation difficult. An improved low cost and wind resistant sign is needed.

SUMMARY OF THE INVENTION

The present disclosure describes a sign panel pivotably affixed to a sign frame that is secured to the ground. The sign panel is formed from corrugated plastic or other material that is primarily planar with rows of parallel channels. The frame is formed from bent metal wire or other equivalent structural material. The frame has a top portion that is formed from parallel crossmembers that connect vertical supports. The crossmembers and vertical supports form an enclosed area where the sign panel resides. The sign panel is attached to the frame through sign pivots that are affixed to the vertical supports and extend partially into one of the channels of the sign panel. The sign pivots form a pivot axis. The vertical supports extend beyond one of the crossmembers and terminate at points that can be driven into the ground.

To install the sign panel to the frame, the sign panel is slid onto one of the sign pivots with the pivot being located in one of the channels. The sign panel is then distorted sufficiently to slide the other sign pivot into the other end of the same channel. An optional stiffener is inserted into the sign panel to prevent distortion that could cause the sign panel to disengage from the sign pivots. Wind or other disturbances cause the sign panel to pivot but then the sign panel returns to a vertical orientation when the disturbance is removed. Because the sign pivots are located near the top of the sign panel, the sign panel naturally returns to a vertical position.

DESCRIPTION OF THE PREFERRED EMBODIMENT

Figure 1:
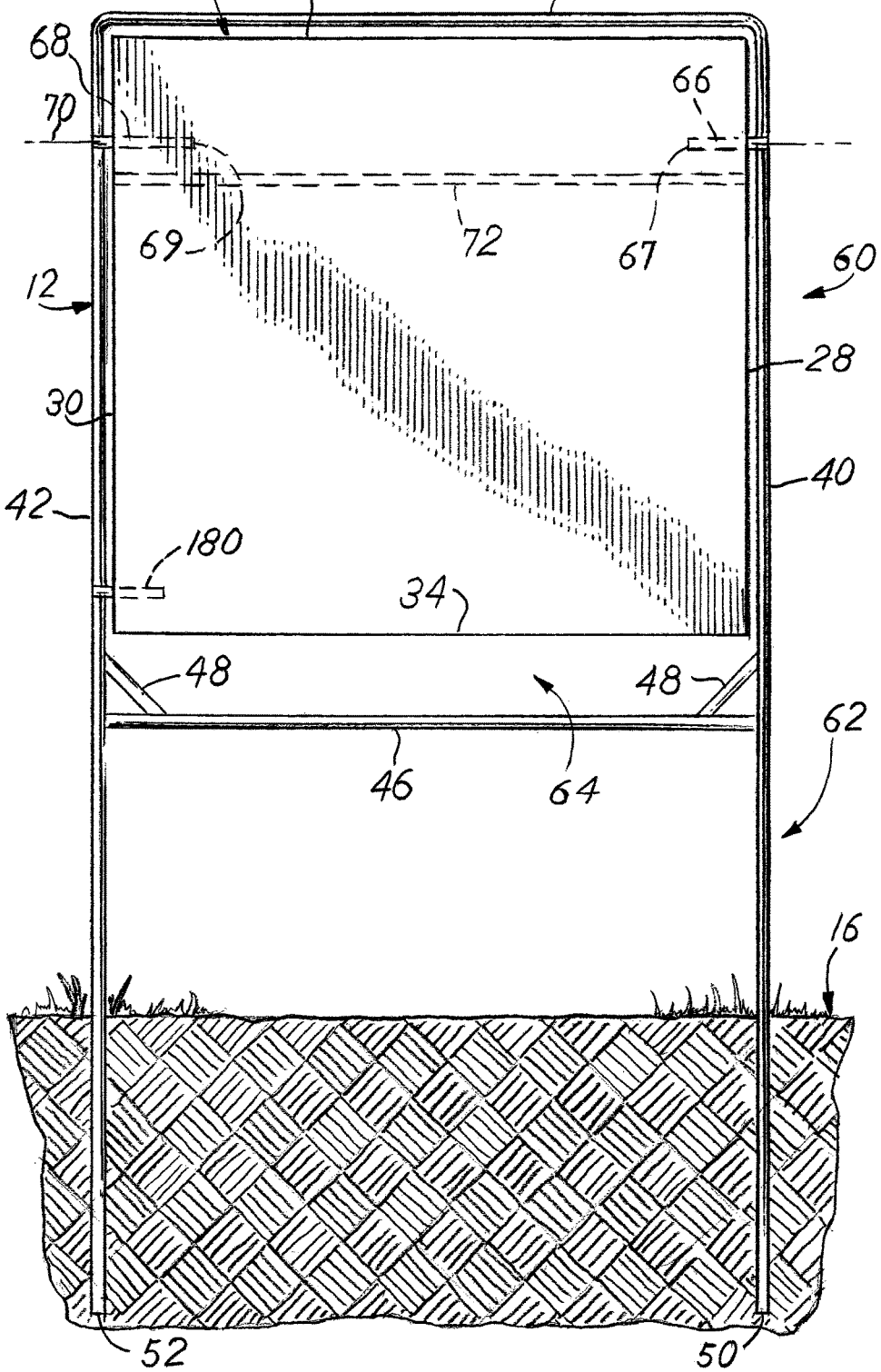
FIG. 1 is a front view of the sign.
Figure 2:
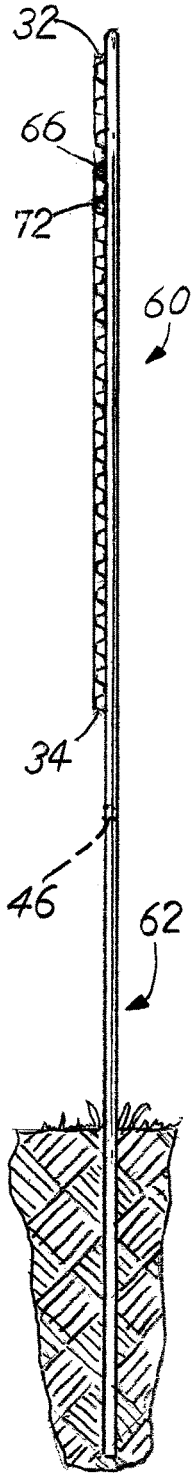
FIG. 2 is a side view the sign in FIG. 1.
Figure 3:
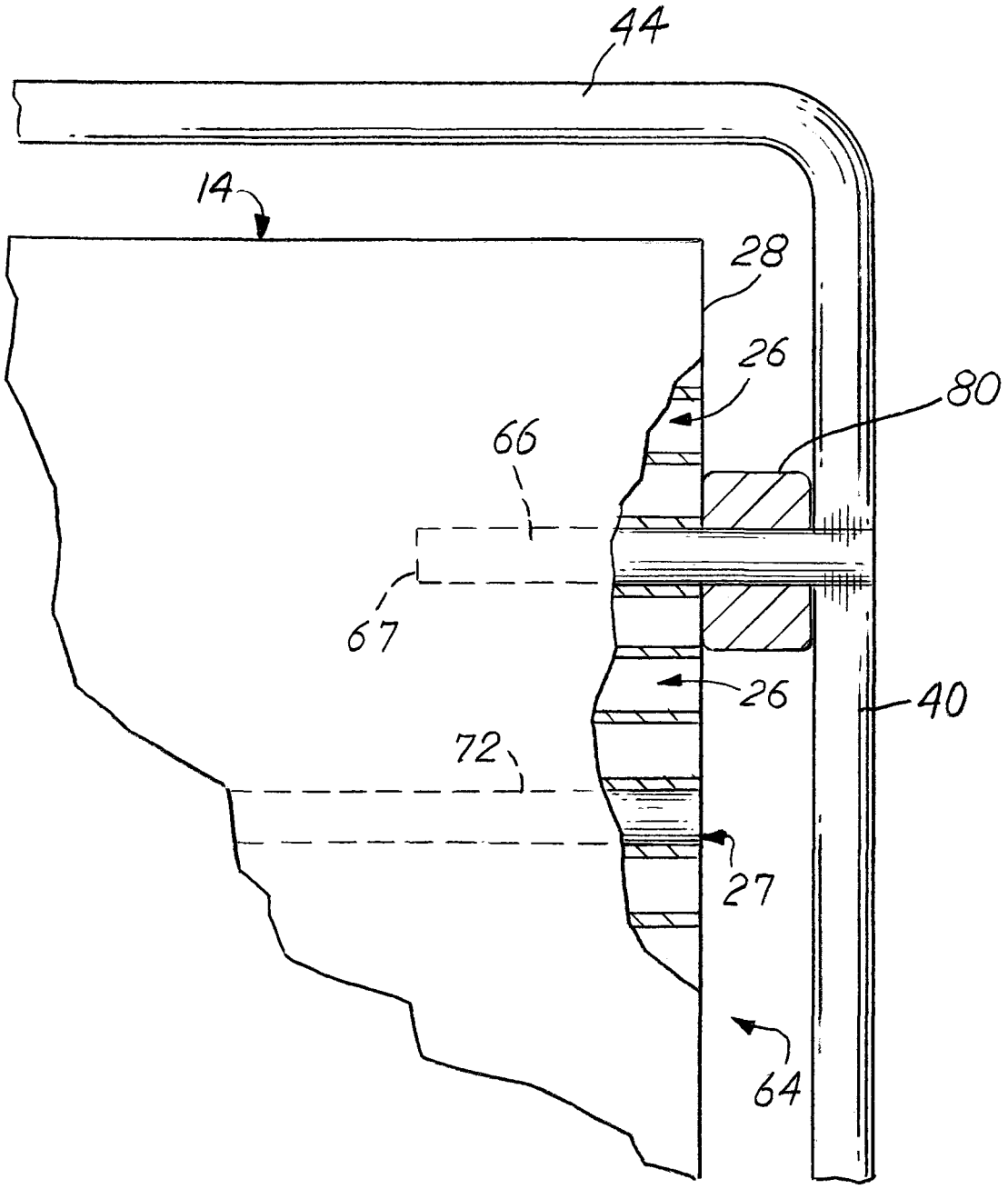
FIG. 3 is a partial view 2 of the sign in FIG. 1.
Figure 4:
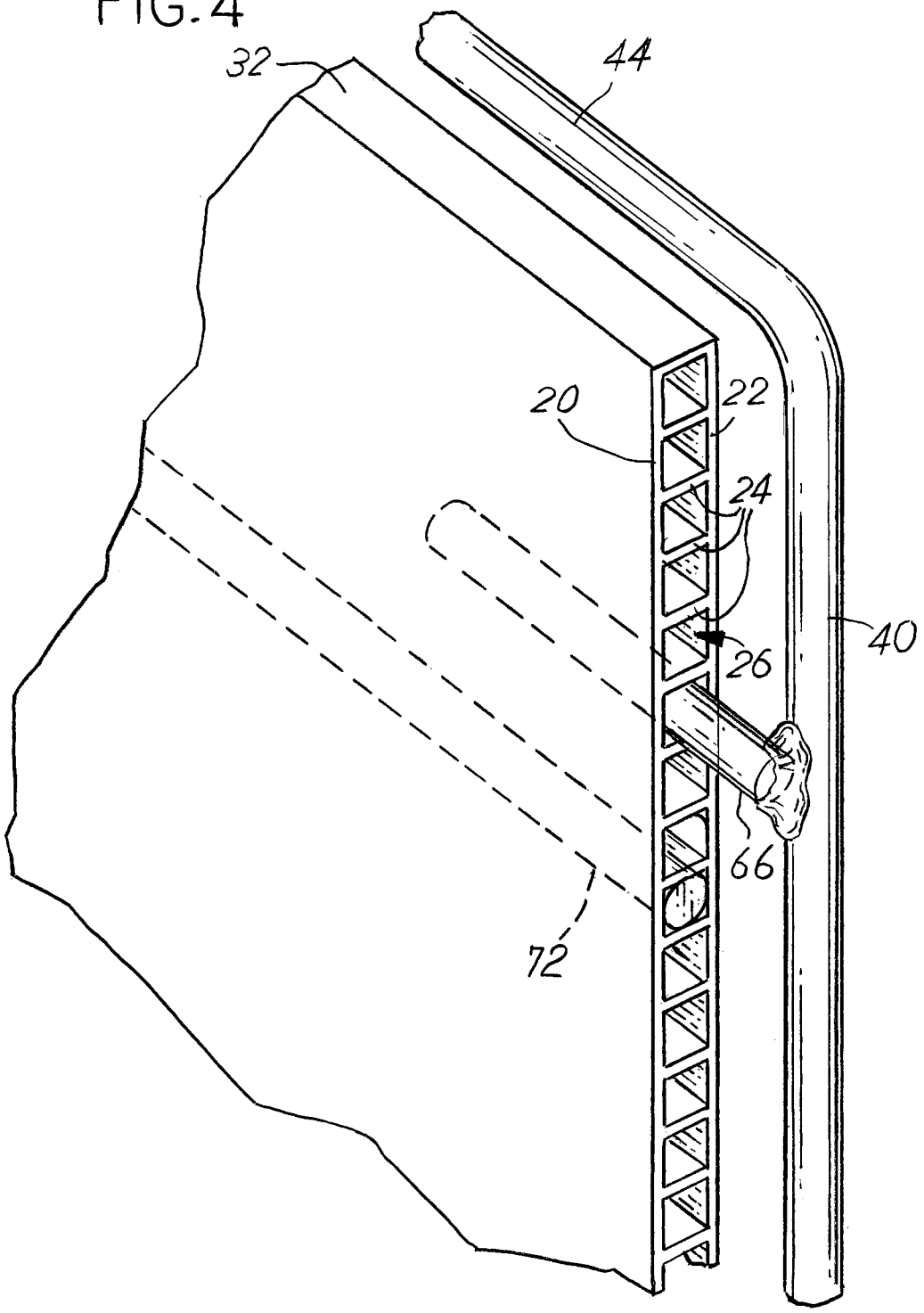
FIG. 4 is an isometric view of partial view 2 shown in FIG. 3.
Figure 5:
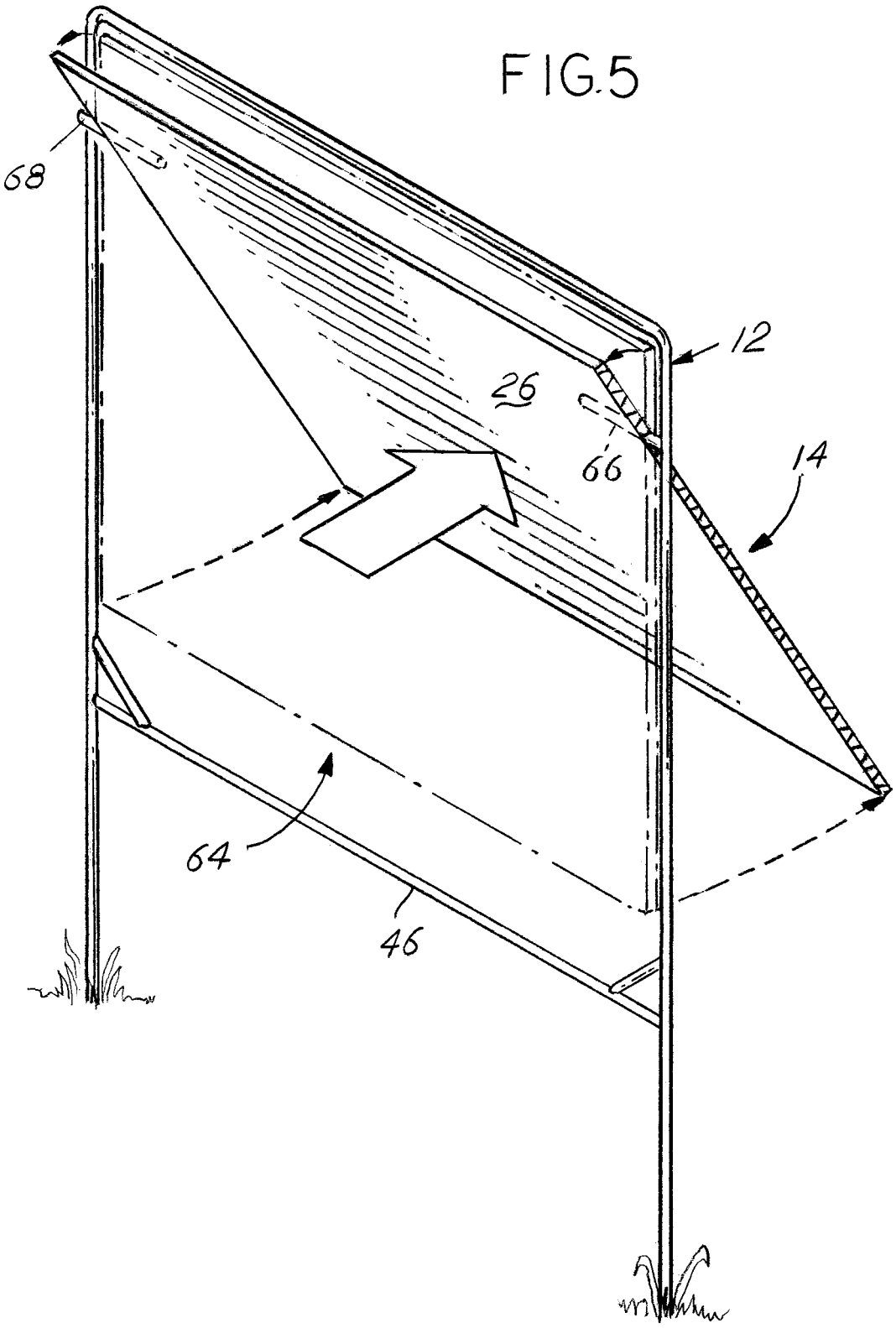
FIG. 5 is an isometric view of the sign in FIG. 1 with an external disturbance.

A sign 10, shown in FIGS. 1, 2, and 5, has a frame 12 and a panel 14. The frame 12 is designed to be secured to the ground 16 and support and suspend the panel 14. The ground 16 is defined as dirt, sand, aggregate, or other displaceable solid that can receive a stake or similar object to secure a structure. The frame 12 allows the panel 14 to pivot with wind or other external forces that apply force. The panel 14 is a planar structure with graphics, text, or other information printed on at least one side. As shown, the panel 14 is formed from corrugated plastic. Corrugated plastic, shown in FIGS. 3 and 4, is well-known in the art as a semi-rigid sheet material with thin skins 20, 22 on the outside with short and tightly spaced joining walls 24 between the skins 20, 22. The joining walls 24 and skins 20, 22 combine to form square tubular channels 26 that run between lateral edges 28, 30. In other words, the channels terminate at the lateral edges 28, 30. The panel is formed from the parallel rows of tubular channels 26. The distance between the lateral edges 28, 30 define a width of the panel 14. The panel has a top edge 32 and a bottom edge 34 that define the height of the panel 14. The top and bottom edges 32, 34 are transverse edges and are parallel to the channels 26. The channels 26 may be non-square or other shapes but have an effective inside diameter that could receive a round pin or shaft and allow the pin to rotate with respect to the channel with minimal resistance.

The frame 12 is commonly formed from bent metal wire or rod and has parallel vertical supports 40, 42. Other materials are contemplated for the frame 12, such as tube, angle iron, rigid plastic, fiberglass, and other structural materials. A top crossmember 44 connects the supports 40, 42 at the top. As shown, the vertical supports 40, 42 and crossmember 44 are formed from a single wire that is bent into a "U" shape, but the frame 12 can be constructed from separate components. A lower crossmember 46 stabilizes and joins the vertical supports 40, 42 and prevents them from being pulled apart or pushed together. The lower crossmember 46 may be affixed through welding, fusing, brazing, or other methods not described herein. The lower crossmember 46 may include support gussets 48 to strengthen the joint between the crossmember 46 and the corresponding vertical support 40, 42. The terminal ends of the vertical supports 40, 42 optionally include pierce points 50, 52 that are sharpened to ease the installation of the frame 12 into the ground. The pierce points 50, 52 may be an angled cut, chisel point, or other shape that is sharp compared to a blunt end. As shown, the frame 12 and panel are symmetrical about a midpoint between the vertical supports 40, 42.

The frame has an upper display portion 60 and a lower stake portion 62, the two portions meeting at the lower crossmember 46. The upper portion 60 forms an enclosed area 64 where the panel 14 resides. Extending inwardly into the enclosed area 64 are sign pivots 66, 68, each affixed to a corresponding vertical support 40, 42. As shown, the sign pivots 66, 68 are perpendicular to the vertical supports 40, 42. The sign pivot 66 is shown in further detail in FIG. 3. The sign pivots 66, 68 are round or cylindrical metal wire that is affixed through welding, fusing, or the like. The sign pivots 66, 68 are aligned with a pivot axis 70 and are sized to fit inside one of the channels 26 in the panel 14. Each sign pivot 66, 68 has a corresponding terminal end 67, 69. The terminal ends 67, 69 are spaced apart by a distance smaller than the width of the panel 14. Further, the terminal end 67 of the sign pivot 66 is spaced from the vertical support 42 and the terminal end 69 of the sign pivot 68 is spaced from the vertical support 40 by a distance smaller than the width of the panel 14. This spacing prevents the panel 14 from sliding off one of the pivots 66, 68. The only way to remove or install the panel 14 is to temporarily distort it enough to bring the lateral edges 28, 30 closer to each other to clear one of the terminal ends 67, 69. In other words, one of the lateral edges 28, 30 would be up against its corresponding vertical support 40, 42 and the panel would be distorted enough to allow the opposite lateral edge 30, 28 to move clear of the terminal end of the pivot 68, 66. The sign pivots 66, 68 are positioned closer to the top crossmember 44 such that when the panel 14 is installed, a majority of it and its mass is below the pivot axis 70. The pivots 66, 68 are loose enough inside the channel 26 to allow the panel 14 to swing freely. The location of the pivots 66, 68 are merely for example and it is contemplated to locate the pivots closer to or farther away from the top crossmember 44 than what is disclosed herein to change the balancing properties of the panel 14. As can be seen in FIGS. 3-6, the channels 26 are parallel to the crossmembers 44, 46.

An optional stiffener 72 is located in a channel 27 below the sign pivots 66, 68, shown in FIGS. 1 and 2, to rigidify the panel 14 and prevent buckling or warpage. Buckling or warpage could cause one or both of the sign pivots 66, 68 to pull out of their corresponding channel 26 and allow the panel 14 to fall out of the frame 12. The stiffener 72 also adds weight to further encourage the panel 14 to remain vertical when at rest. The stiffener 72 is sized such that it cannot easily slide out of its channel 27. This could be done by adding a small kink, using a larger diameter rod or wire, or including a stamped feature that causes enough interference to retain the stiffener 72 in its channel 27. While the stiffener 72 is shown close to the sign pivots 66, 68, it is contemplated that the stiffener 72 is located closer to the bottom edge 34 to encourage the panel 14 to remain vertical. It is further contemplated that additional stiffeners 72 are located in the panel 14. Additional stiffeners 72 provide more weight to encourage the panel 14 to remain vertical in gentle breezes.

The enclosed area 64 is larger than the area of the panel 14 to give it room to pivot without contacting or otherwise interfering with the vertical supports 40, 42, crossmembers 44, 46, or gussets 48. In the event the pivots 66, 68 are slightly offset from their corresponding vertical supports 40, 42, the panel 14 may be slightly offset from the enclosed area, as shown in FIG. 2. This may be caused by how the pivots 66, 68 are attached. If they overlay and are welded, as shown in FIG. 4, the thickness of the pivots and vertical supports creates a slight offset. In this scenario, the panel 14 is still considered to be located within the enclosed area 64. Because the lateral edges 28, 30 of the panel 14 are straight and the interface between the channel 26 and the sign pivots 66, 68 are relatively loose, it is possible the panel 14 can shift closer to one of the vertical supports 40, 42, where it can contact and rub against the support. This can happen if the sign 10 is installed at an angle with respect to the ground, and movements with wind or other external disturbance causes the panel to slowly work itself closer and closer to the support. It can also happen with wind that deflects the panel 14 at an angle, slowly encouraging it toward one of the vertical supports 40, 42. If the panel 14 contacts one of the supports 40, 42, the free-swinging nature of the panel 14 will be negatively impacted, resulting in it dragging and becoming stuck. In order to prevent this undesired result, spacers 80 can be located on the sign pivots 66, 68 between the vertical supports 40, 42 and the panel 14. The spacers 80 can be a cylindrical or other component with a central aperture sized to fit on the sign pivots 66, 68. The spacers 80 would be constructed from materials that would tolerate outdoor use and resist corrosion, such as plastic. It is contemplated that the spacers can be a snap on style, where the panel 14 is installed on the sign pivots 66, 68 and the spacer is a C shaped clip or other style that can snap onto the exposed portions of the sign pivots 66, 68 after the panel 14 is in place. The C shaped clip has an inside diameter large enough to accommodate the diameter of the sign pivots 66, 68 with the opening being smaller. The user would press the clip with the opening against the sign pivot 66, 68 and temporarily distorting the shape of the clip to snap it in place.

Figure 6:
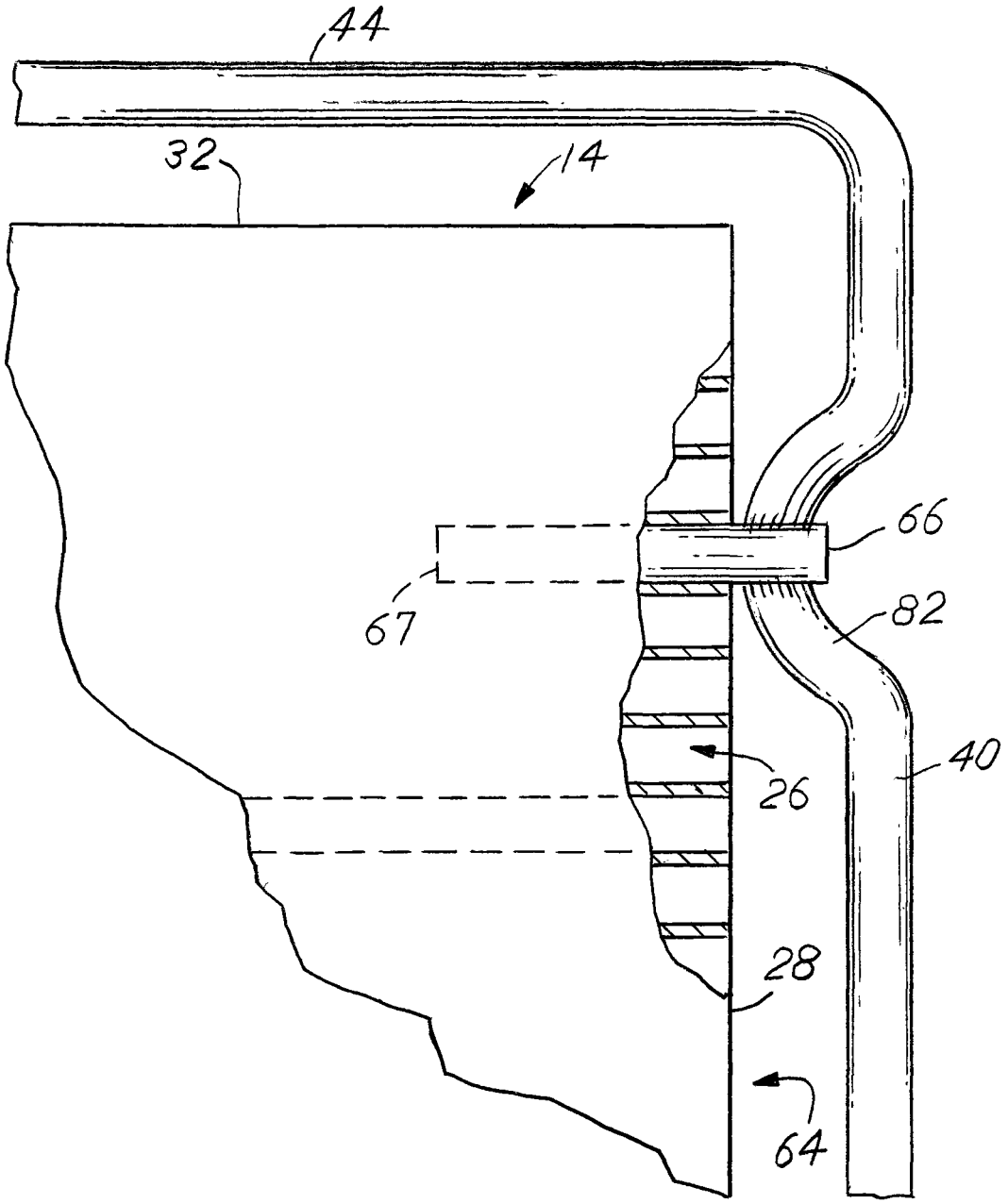
FIG. 6 is a partial view 2 of the sign in FIG. 1 with an alternate spacer.

It is contemplated that the spacer 80 is instead integrated into the vertical support 40, 42 as is shown FIG. 6. This can be accomplished by adding a bend 82 that extends into the enclosed area 64. The bend 82 is an arcuate or otherwise stepped portion integrally formed in to the vertical supports 40, 42. If the panel shifts 14, it first contacts the bend 82, where any additional friction by the side 28, 30 rubbing on the vertical support 40, 42 has minimal impact.

Figure 7:
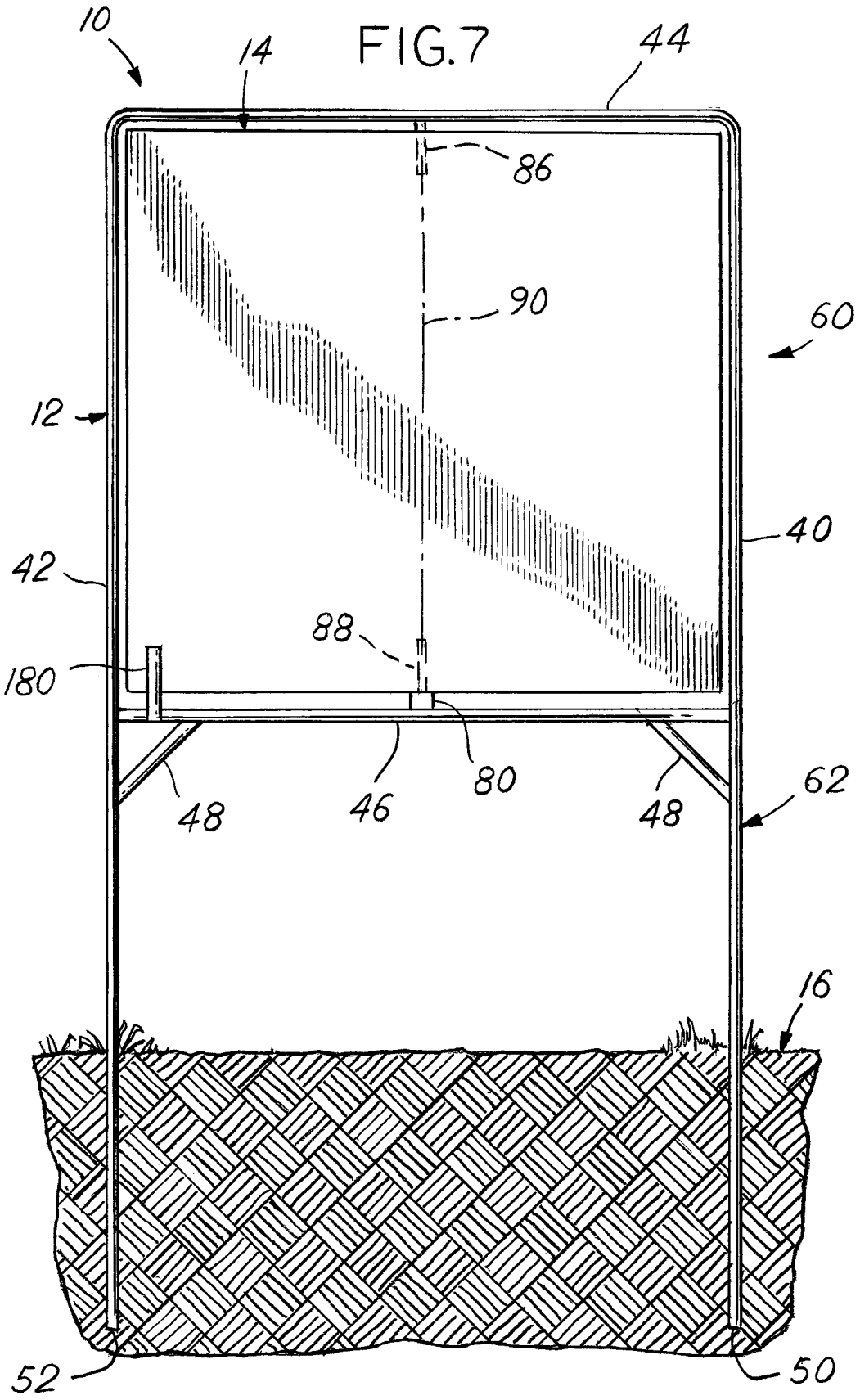
FIG. 7 is a front view of the sign in FIG. 1 with an alternate pivoting location.

It may be desirable to have the panel 14 pivot about a vertical axis, as is shown in FIG. 7. In this orientation, the panel 14 is situated such that vertical pivots 86, 88 are parallel to the vertical supports 40, 42 and located at a midpoint between them on the crossmembers 44, 46. The pivots 86, 88 form a pivot axis 90. In this orientation, the panel 14 would be positioned so the channels 26 would be vertical. Because the panel 14 would be biased towards the lower crossmember 46, a spacer 80 or equivalent would be needed to prevent the panel 14 from dragging or becoming stuck on the lower crossmember 46.

To manufacture the frame 12, a steel wire is bent into a "U" shape to form the vertical supports 40, 42 and top crossmember 44. The lower crossmember 46 and gussets 48 are secured to the vertical supports 40, 42, along with the sign pivots 66, 68. The panel 14 is cut from a sheet of corrugated plastic and the design, information, or other advertisement is applied to the skins 20, 22. To install the panel 14 to the frame 12, the user selects the channel 26 to install onto one of the sign pivots 66, 68 that will position the panel 14 clear of the top crossmember 44 and lower cross member 46. If a spacer 80 is used, the spacer is slid onto the sign pivot 66, 68. The user then slides one of the sign pivots 66, 68 into that channel 26 until it contacts the vertical support 40, 42. To slide the other sign pivot 68, 66 into the other end of the channel 26, the user bends the panel 14 enough to bring the lateral edge 28, 30 to allow the other sign pivot 68, 66 to slide in. The user then pivots the panel 14 and installs the stiffener 72 into channel 27.

In use, the sign 10 is partially inserted into the ground 16 as shown in FIGS. 1, 2, and 5. The frame 12 is oriented as vertical as possible, which allows the panel 14 to be located in the enclosed area 64. In the event the frame 12 is installed in a non-vertical orientation, the panel 14 will hang vertically but not be located inside the enclosed area 64. When wind or other external disturbance occurs, the panel 14 pivots about the pivot axis 70 but then returns to vertical when the wind dies down or the external disturbance is removed.

For sign panels 14 that are manufactured with the channels 26 being vertical, an alternate sign 110 may be desired. Shown in FIGS. 8-10, the alternate sign 110 has a frame 112 and a panel 114. The panel 114 is corrugated with vertical channels 126. The frame 112 uses vertical supports 140, 142 and has a top crossmember 144 and an optional lower crossmember 146. As with the frame 12, the crossmembers 144, 146 and vertical supports 140, 142 form an enclosed area 164 where the panel 114 resides. The top crossmember 144 has two hanging posts 166, 168 that are captured to the crossmember 144. The frame 112 is shown with break lines between one style of hanging post 166 on the left side and a different style of hanging posts 168 on the right side. The hanging posts 166, 168, at least partially, are sized larger than the vertical channels 126. The hanging posts 166, 168 create an interference fit between the hanging post 166, 168 and its corresponding channel 126. The interference fit between the posts 166, 168 and the panel 114 may be accomplished by adding barbs 167. The barbs 167 extend outwardly from the shaft portions 171, 172 to create interference between the walls of the channel 126. The barbs 167 may be angled to cause the barbs to dig in to the walls if any force attempts to pull the posts 166, 168 out of its respective channel 126. Because the panel 114 hangs from the hanging posts 166, 168, the interference fit maintains the position of the panel 114 and prevents it from falling off or sliding down. The hanging posts 166, 168 have an eyelet portion 169 where they are captured on the top crossmember 144 and pivot about a pivot axis 170. The eyelet may be formed by bending the post around into a closed hook or through a notch 174 shown in FIG. 9 or stop 176 shown in FIG. 10. The stop 176 limits axial movement of the hanging posts 166, 168 to prevent the panel 144 from contacting the vertical supports 140, 142.

Figure 8:
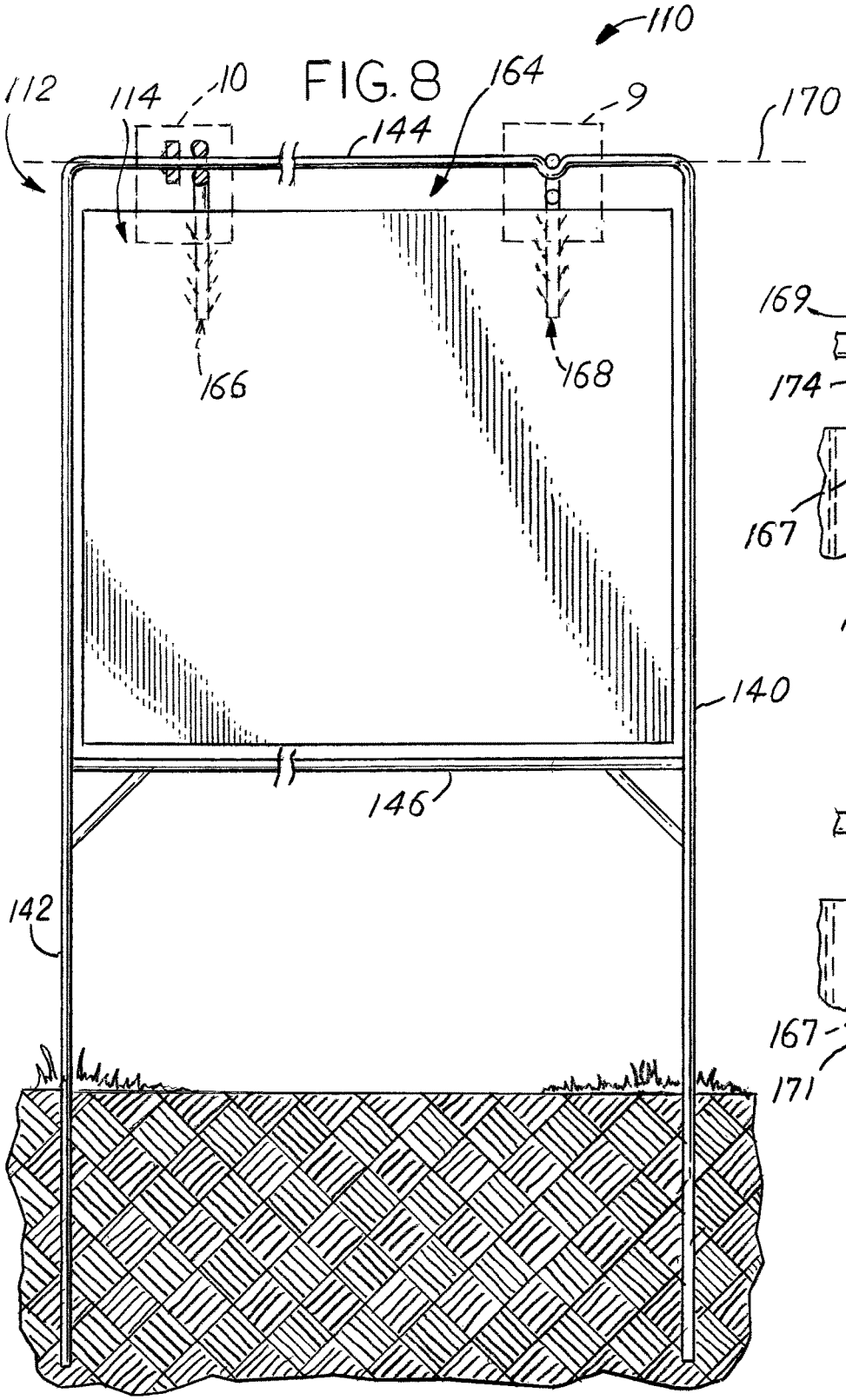
FIG. 8 is a front view of the sign in FIG. 1 with an alternate pivoting location.

To manufacture the sign 110 as shown in FIG. 8, the frame 112 is formed similarly to the frame 12. In the event the hanging posts 166, 168 use an eyelet portion 169 that is completely enclosed, the hanging posts 166, 168 are placed on the frame 112 before the lower crossmember 146 is affixed. If the style of hanging post 166 is used, the stops 176 are installed before the lower crossmember 146 is affixed. For hanging posts 166, 168 that are formed into a hook, the hook portion can be formed around the top crossmember 144 or placed on the frame 114 before assembly.

Figure 9:
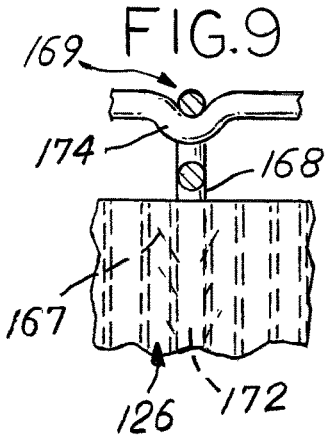
FIG. 9 is a partial view 9 of the pivoting mechanism in FIG. 8.
Figure 10:
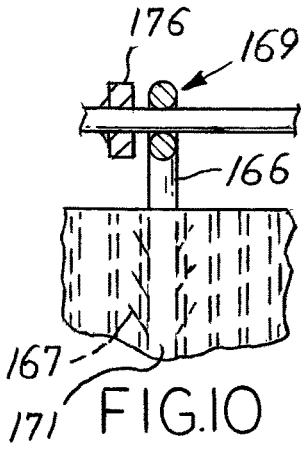
FIG. 10 is a partial view 10 of an alternate pivoting mechanism in FIG. 8.

The panel 114 is pressed on to the hanging posts 166, 168 such that the channels 126 that receive the posts are aligned with the notches 174 for the design as shown in FIG. 9. In the event the notches 174 are not present, the posts are aligned with channels 126 that allow limited axial movement of the hanging posts 166, 168, but not enough to allow the panel 114 to contact the frame 112.

The user may desire to prevent the sign panel 14, 114, from pivoting, either during assembly, shipping, placement, or other situations involving the sign 10, 110. For example, for a political candidate that carries a large stack of signs around, pulling one sign off of the top of the stack may result in entanglement with other signs if the panel 14, 114 is allowed to pivot. This could result in frustration and/or damage to the sign or adjacent signs. In this case, an optional swing stopper 180 may be included that ties the panel 14, 114 to the frame 12, 112. The swing stopper 180 may extend into one of the channels near the bottom edge 34 on frame 12, near one of the vertical supports 40, 42 for the sign shown in FIG. 7, or near one of the vertical supports 140, 142 for the sign shown in FIG. 8. The swing stopper 180 may be a break-away style, where enough force would dislodge or break the stopper and allow the sign panel 14, 114 to pivot. The break-away function can be accomplished by weakly connecting the stopper 180 to the frame or panel or through the use of sacrificial materials.

It is understood that while certain aspects of the disclosed subject matter have been shown and described, the disclosed subject matter is not limited thereto and encompasses various other embodiments and aspects. No specific limitation with respect to the specific embodiments disclosed herein is intended or should be inferred. Modifications may be made to the disclosed subject matter as set forth in the following claims.

What is claimed is:

1. A wind resistant sign comprising:

a frame having a first vertical support affixed to a top crossmember, said top crossmember affixed to a second vertical support being spaced from and parallel to said first vertical support, said frame having a lower crossmember connecting and affixed to said vertical supports, said lower crossmember spaced from and parallel to said top crossmember, said vertical supports extending beyond said lower crossmember and each terminating at a corresponding terminal end, said lower crossmember forming a boundary between a lower portion and an upper display portion of said frame, said upper display portion forming an enclosed area, said frame having a first sign pivot affixed to said first vertical support and a second sign pivot affixed to said second vertical support, said first and second sign pivots extending towards each other into said enclosed area and forming a pivot axis, said pivot axis located closer to said top crossmember than said lower crossmember;

a panel formed from corrugated material having a first skin affixed to a second skin through parallel channels located therebetween;

one of said parallel channels partially receiving said first sign pivot on one end and said second sign pivot on a second end, said panel pivoting about said pivot axis; and a stiffener located in a second channel in said panel adjacent said one parallel channel.

2. The wind resistant sign of claim 1, wherein said panel having a width defined by a distance between lateral edges, said first sign pivot having a terminal end and said second sign pivot having a terminal end, said terminal end of said first sign pivot spaced from said second vertical support by a distance smaller than said width of said panel, said terminal end of said second sign pivot spaced from said first vertical support by said distance.

3. The wind resistant sign of claim 1, further comprising a first spacer located on said first sign pivot between said panel and said first vertical support, a second spacer located on said second sign pivot between said panel and said second vertical support.

4. The wind resistant sign of claim 1, wherein said parallel channel has an effective inside diameter, said first and second sign pivots having a diameter smaller than said effective inside diameter.

5. The wind resistant sign of claim 1, further comprising a first gusset affixed to said lower crossmember and said first vertical support, and a second gusset affixed to said lower crossmember and said second vertical support.

6. The wind resistant sign of claim 1, wherein said parallel channels are parallel to said crossmembers.

7. The wind resistant sign of claim 1, wherein said pivot axis extends through said panel.

8. A wind resistant sign for being affixed to the ground, said sign comprising:

a frame having a first vertical support and a second vertical support, said vertical supports affixed to a top crossmember, said frame having a lower crossmember connecting and affixed to said vertical supports, said lower crossmember spaced from and parallel to said top crossmember, said lower crossmember forming a boundary between a lower portion and an upper display portion of said frame, said lower portion for affixing said frame to said ground, said upper display portion forming an enclosed area, said frame having a first sign pivot and a second sign pivot affixed thereto, said first and second sign pivots extending into said enclosed area and forming a pivot axis;

a first bend on said first vertical support where said first sign pivot is affixed, a second bend on said second vertical support where said second sign pivot is affixed, said first and second bend facing each other and extending into said enclosed area;

a panel formed from corrugated material having parallel channels located between and connecting a first skin to a second skin;

one of said parallel channels partially receiving said first sign pivot on one end and said second sign pivot on a second end, said panel pivotable about said pivot axis; and wherein said panel having a width defined by a distance between lateral edges, said first sign pivot having a terminal end and said second sign pivot having a terminal end, said terminal end of said first sign pivot spaced from said second vertical support by a distance smaller than said width of said panel, said terminal end of said second sign pivot spaced from said first vertical support by said distance.

9. The wind resistant sign of claim 8, further comprising a first spacer located on said first sign pivot between said panel and said first vertical support, a second spacer located on said second sign pivot between said panel and said second vertical support.

10. The wind resistant sign of claim 8, further comprising a swing stopper affixed to said frame and preventing said panel from pivoting.

11. The wind resistant sign of claim 10, wherein said swing stopper is releasable.

12. A wind resistant sign comprising:

a frame having a first vertical support affixed to a top crossmember, said top crossmember affixed to a second vertical support being spaced from and parallel to said first vertical support, said frame having a lower crossmember connecting and affixed to said vertical supports, said lower crossmember spaced from and parallel to said top crossmember, said vertical supports extending beyond said lower crossmember and each terminating at a corresponding terminal end, said lower crossmember forming a boundary between a lower portion and an upper display portion of said frame, said upper display portion forming an enclosed area, said frame having a first sign pivot affixed to said first vertical support and a second sign pivot affixed to said second vertical support, said first and second sign pivots extending towards each other into said enclosed area and forming a pivot axis, said pivot axis located closer to said top crossmember than said lower crossmember;

a first bend on said first vertical support where said first sign pivot is affixed, a second bend on said second vertical support where said second sign pivot is affixed, said first and second bend facing each other and extending into said enclosed area;

a panel formed from corrugated material having a first skin affixed to a second skin through parallel channels located therebetween; and one of said parallel channels partially receiving said first sign pivot on one end and said second sign pivot on a second end, said panel pivoting about said pivot axis.

13. The wind resistant sign of claim 12, wherein said panel having a width defined by a distance between lateral edges, said first sign pivot having a terminal end and said second sign pivot having a terminal end, said terminal end of said first sign pivot spaced from said second vertical support by a distance smaller than said width of said panel, said terminal end of said second sign pivot spaced from said first vertical support by said distance.

14. The wind resistant sign of claim 12, wherein said one of said parallel channels has an effective inside diameter, said first and second sign pivots having a diameter smaller than said effective inside diameter.

15. The wind resistant sign of claim 12, further comprising a first gusset affixed to said lower crossmember and said first vertical support, and a second gusset affixed to said lower crossmember and said second vertical support.

16. The wind resistant sign of claim 12, wherein said parallel channels are parallel to said crossmembers.

17. The wind resistant sign of claim 12, wherein said pivot axis extends through said panel.

* * * * *